US009904192B2

(12) United States Patent
Ohta

(10) Patent No.: US 9,904,192 B2
(45) Date of Patent: Feb. 27, 2018

(54) TONER

(71) Applicant: ZEON CORPORATION, Tokyo (JP)

(72) Inventor: Ryuji Ohta, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 15/019,403

(22) Filed: Feb. 9, 2016

(65) Prior Publication Data

US 2016/0246196 A1 Aug. 25, 2016

(30) Foreign Application Priority Data

Feb. 19, 2015 (JP) ..... 2015-030662

(51) Int. Cl.
*G03G 9/087* (2006.01)
*G03G 9/097* (2006.01)
*G03G 9/08* (2006.01)

(52) U.S. Cl.
CPC ..... *G03G 9/08711* (2013.01); *G03G 9/0821* (2013.01); *G03G 9/08728* (2013.01); *G03G 9/09741* (2013.01); *G03G 9/09775* (2013.01)

(58) Field of Classification Search
CPC ..... G03G 9/08711; G03G 9/09741; G03G 9/08728; G03G 9/0821
See application file for complete search history.

(56) References Cited

U.S. PATENT DOCUMENTS 4,299,898 A * 11/1981 Williams ..... G03G 9/08706 430/109.31
5,516,612 A * 5/1996 Vianco ..... G03G 9/08788 430/106.2
5,716,751 A * 2/1998 Bertrand ..... G03G 9/0804 241/15
7,314,695 B2 * 1/2008 Harada ..... G03G 9/08704 430/108.22
2003/0027070 A1 * 2/2003 Niwa ..... G03G 9/08704 430/108.22
2004/0013961 A1 * 1/2004 Niwa ..... G03G 9/0806 430/107.1
2006/0127786 A1 * 6/2006 Sugawa ..... G03G 9/081 430/108.1
2009/0130583 A1 * 5/2009 Katsuta ..... G03G 9/0804 430/108.5
2010/0035171 A1 * 2/2010 Watanabe ..... C09B 29/363 430/108.23
2013/0040235 A1 * 2/2013 Takatsuna ..... G03G 9/09708 430/108.3
2013/0130165 A1 * 5/2013 Kinumatsu ..... G03G 9/0802 430/109.1
2013/0216274 A1 * 8/2013 Ito ..... G03G 15/0818 399/274
2014/0064792 A1 * 3/2014 Kawamura ..... G03G 9/0821 399/252
2016/0004176 A1 * 1/2016 Masuda ..... G03G 9/08728 430/111.4

FOREIGN PATENT DOCUMENTS

JP 2010-91704 A 4/2010
JP 2011-150125 A 8/2011
JP 2011-215179 A 10/2011
WO WO 2014133032 A1 * 9/2014 ..... G03G 9/08728

* cited by examiner

*Primary Examiner* — Christopher D Rodee
(74) *Attorney, Agent, or Firm* — Westerman, Hattori, Daniels & Adrian, LLP

(57) ABSTRACT

Provided is a toner that is excellent in heat-resistant shelf stability and low-temperature fixability, has durability, and causes less occurrence of fogging in high temperature and high humidity environments.
The toner comprising at least a binder resin, a colorant, a release agent, a retention aid and a charge control resin. The binder resin is a copolymer containing a styrene-based monomer unit 67 to 78% by mass and a (meth)acrylic acid alkyl monomer unit 22 to 33% by mass. The content of the retention aid is 1 to 4 parts by mass with respect to 100 parts by mass of the binder resin, and the content of the charge control resin is 0.1 to 20 parts by mass with respect to 100 parts by mass of the binder resin.

1 Claim, No Drawings

TONER

BACKGROUND OF THE INVENTION

Technical Field

The present invention relates to a toner which can be used for the development of image forming devices utilizing electrophotography such as copying machines, facsimile machines and printers.

Background Art

In recent years, regarding laser printers and copying machines utilizing electrophotography, a process speed has been increased at a fast pace, and a toner excellent in development performance, transferability, and low-temperature fixability has been demanded. In particular, since the low-temperature fixability contributes to saving of power consumption, it is regarded as an essential factor in recent development of toners of the type that is strongly required to be adapted for environmental countermeasures.

Meanwhile, with increasing market expansion of laser printers and copying machines, toners have been demanded to stably exhibit the performance even in use in environments ranging from low temperature and low humidity environments to high temperature and high humidity environments. Therefore, researches are directed to development of a toner having excellent durability in an environment different from the low-temperature fixability.

For example, Patent Literature 1 discloses a toner including toner particles containing at least a binder resin, a release agent, a polar resin and a sulfur atom-containing polymer and inorganic fine particles, wherein the polar resin is a vinyl polymer having at least one of a carboxyl group and a hydroxyl group. In Patent Literature 1, when the interfacial tension to water of the sulfur atom-containing polymer dissolved in styrene which is measured by the pendant drop method is a (mN/m) and the interfacial tension to water of the polar resin dissolved in styrene which is measured by the pendant drop method is b (mN/m), a and b are specified as follows:

$$a+5.0 \leq b \qquad \text{Formula I:}$$

$$17.0 \leq b \leq 24.0 \qquad \text{Formula II:}$$

An object of the invention of Patent Literature 1 is to provide a method in which when the material that satisfies the above Formula I is selected, the sulfur atom-containing polymer tends to be preferentially located near the surface of toner particles, then even if many sheets of paper are printed, the occurrence of defects such as developing stripes, dropping, and fogging is prevented and further the image density becomes stable. In the invention, another object is to provide a method in which when the material is selected so as to satisfy the above Formula II, the moisture content on the surface of toner particles are stably maintained in environments ranging from low humidity environment to high humidity environment.

Patent Literatures 2 to 3 disclose toners in which the interfacial tension to water when yellow pigment and magenta pigments as colorants are dispersed or dissolved in styrene satisfies the specified relationship, in addition to the relationship in Patent Literature 1.

However, in the case of the toners obtained by the methods described in the Patent Literatures, it is difficult to achieve a balance between decrease in fixing temperature and shelf stability at high temperatures and satisfy demands of continuous printing durability and printing durability after storage at high temperatures. Further, the print quality in a different environment, particularly a high temperature and high humidity (H/H) environment have been sometimes insufficient.

Patent Literature 1: Japanese Patent Application Laid-Open (JP-A) No. 2010-91704

Patent Literature 2: JP-A No. 2011-150125

Patent Literature 3: JP-A No. 2011-215179

In the methods disclosed in Patent Literatures 1 to 3, the interfacial tension to water of styrene and the interfacial tension to water of a styrene dispersion of a toner material are used in the selection of the toner material. However, Patent Literatures 1 to 3 disclose polymerizable monomers, for example in addition to styrene, other styrene monomers such as methylstyrene, (meth)acrylic acid ester monomers such as methyl methacrylate, and ene-based monomers such as cyclohexene. Particularly, if a monomer having a high polarity, like (meth)acrylic acid ester monomers, is used with styrene, the interfacial tension to water is relatively low as compared to the case of using only styrene. In an aqueous medium, styrene tends to agglutinate inside oil droplets as compared to the monomer having a high polarity. Thus, the distribution state of the polymerizable monomer in the oil droplets is changed depending on the use of the monomer having a high polarity. Therefore, the above Formulae I and II using the interfacial tension of the styrene dispersion do not accurately describe the actual state of the oil droplets of the polymerizable monomer composition.

SUMMARY OF THE INVENTION

In order to solve the above problems, an object of the present invention is to provide a toner that has an excellent balance between heat-resistant shelf stability and low-temperature fixability, is excellent in durability during regular use and after being left at high temperatures, and causes less occurrence of fogging in high temperature and high humidity environments.

In order to solve the above problems, the present inventors have made diligent researches on the interfacial interaction between inside or outside of oil droplets. As a result, they have focused on the fact that, when the dispersibility of a toner material such as a retention aid or a charge control resin is evaluated based on the interfacial tension, the composition of a dispersion for evaluation is closer to the composition of a polymerizable monomer used for production of toner particles, thereby enabling a toner material having excellent dispersibility to be selected. That is, they have found that, when the interfacial tension to water of a mixture containing styrene, n-butyl acrylate, and a retention aid and/or charge control resin at a specific ratio falls within a specified range and the used retention aid and charge control resin respectively have specific glass transition temperatures, the above problems can be solved.

That is, according to the present invention, provided is a toner including a binder resin, a colorant, a release agent, a retention aid, and a charge control resin, wherein the binder resin is a copolymer containing 67 to 78% by mass of a styrene-based monomer unit and 22 to 33% by mass of a (meth)acrylic acid alkyl monomer unit; wherein the styrene-based monomer unit is a monomer unit relating to at least one kind of monomer selected from the group consisting of styrene, vinyltoluene, methylstyrene and ethylstyrene; wherein the (meth)acrylic acid alkyl monomer unit is a monomer unit relating to at least one kind of monomer selected from the group consisting of methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, and dimethylaminoethyl methacrylate; wherein a content of the retention aid is 1 to 4 parts by mass with respect to 100 parts by mass of the binder resin; wherein a content of the charge control resin is 0.1 to 20 parts by mass with respect to 100 parts by mass of the binder resin; and wherein, when an interfacial tension of a solution of 1 part by mass of the retention aid dissolved in a mixture of 72 parts by mass of styrene and 28 parts by mass of n-butyl acrylate is α (mN/m) with respect to water, and an interfacial tension of a solution of 1 part by mass of the charge control resin dissolved in a mixture of 72 parts by mass of styrene and 28 parts by mass of n-butyl acrylate is β (mN/m) with respect to water, the following formulae (1) to (3) are all satisfied and a glass transition temperature of the retention aid and that of the charge control resin are 60 to 80° C. and 55 to 90° C., respectively:

$$19.0 \leq \alpha \leq 21.6 \quad \text{Formula (1):}$$

$$13.0 \leq \beta \leq 22.0 \quad \text{Formula (2):}$$

$$-1.0 \leq \alpha - \beta \leq 7.0 \quad \text{Formula (3):}$$

In the present invention, the charge control resin is preferably a positively-chargeable charge control resin containing a quaternary ammonium salt.

In the present invention, the retention aid is preferably a copolymer of at least one of acrylic acid and methacrylic acid, and at least one of acrylic acid ester and methacrylic acid ester.

According to the present invention described above, a binder resin which is a copolymer containing a polymerizable monomer unit having a specific composition within a specific range is used for a toner in combination with a retention aid in which the interfacial tension α to a water of the retention aid solution having a specific composition satisfies the formulae (1) to (3) and which has a specific range of glass transition temperature and a charge control resin in which the interfacial tension β to a water of the charge control resin solution having a specific composition satisfies the formulae (1) to (3) and which has a specific range of glass transition temperature so that there is provided a toner that has an excellent balance between heat-resistant shelf stability and low-temperature fixability, is excellent in durability during regular use and after being left at high temperatures, and causes less occurrence of fogging in high temperature and high humidity environments.

DETAILED DESCRIPTION OF THE INVENTION

A toner of the present invention includes a binder resin, a colorant, a release agent, a retention aid, and a charge control resin, and the binder resin is a copolymer containing 67 to 78% by mass of a styrene-based monomer unit and 22 to 33% by mass of a (meth)acrylic acid alkyl monomer unit; the styrene-based monomer unit is a monomer unit relating to at least one kind of monomer selected from the group consisting of styrene, vinyltoluene, methylstyrene and ethylstyrene; the (meth)acrylic acid alkyl monomer unit is a monomer unit relating to at least one kind of monomer selected from the group consisting of methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, and dimethylaminoethyl methacrylate; a content of the retention aid is 1 to 4 parts by mass with respect to 100 parts by mass of the binder resin: a content of the charge control resin is 0.1 to 20 parts by mass with respect to 100 parts by mass of the binder resin; and when an interfacial tension of a solution of 1 part by mass of the retention aid dissolved in a mixture of 72 parts by mass of styrene and 28 parts by mass of n-butyl acrylate is α (mN/m) with respect to water, and an interfacial tension of a solution of 1 part by mass of the charge control resin dissolved in a mixture of 72 parts by mass of styrene and 28 parts by mass of n-butyl acrylate is β (mN/m) with respect to water, the following formulae (1) to (3) are all satisfied and a glass transition temperature of the retention aid and that of the charge control resin are 60 to 80° C. and 55 to 90° C., respectively:

$$19.0 \leq \alpha \leq 21.6 \quad \text{Formula (1):}$$

$$13.0 \leq \beta \leq 22.0 \quad \text{Formula (2):}$$

$$-1.0 \leq \alpha - \beta \leq 7.0 \quad \text{Formula (3):}$$

Hereinafter, the toner of the present invention will be described.

The toner of the present invention contains at least a binder resin, a colorant, a release agent, a retention aid and a charge control resin.

Hereinafter, a method for producing the colored resin particles, the colored resin particles obtained by the production method, a method for mixing the colored resin particles with an external additive, and the toner of the present invention will be described in this order.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method preferable among the wet methods is performed by the following processes.

(A) Suspension Polymerization Method (A-1) Preparation Process of Polymerizable Monomer Composition First, a polymerizable monomer, a colorant, a release agent, a retention aid and charge control resin, and other additives such as a molecular weight modifier etc., which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerizable to be a binder resin. As the polymerizable monomer, a styrene-based monomer and a (meth)acrylic acid alkyl monomer are mainly used.

As the styrene monomers, styrene, vinyltoluene, methylstyrene and ethylstyrene are used. These monomers may be used alone or in combination of two or more kinds. Among them, it is preferable to use at least one of styrene, vinyltoluene and methylstyrene, and it is more preferable to use styrene.

Examples of the (meth)acrylic acid alkyl monomer to be used include methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate and dimethylaminoethyl methacrylate. These monomers may be used alone or in combination of two or more kinds. Among them, it is preferable to use at least one of ethyl acrylate, propyl acrylate and butyl acrylate, and it is more preferable to use n-butyl acrylate.

The binder resin is a copolymer containing at least the styrene-based monomer unit in the range from 67 to 78% by mass and the (meth)acrylic acid alkyl monomer unit in the range from 22 to 33% by mass. If the styrene-based monomer unit is less than 67% by mass and the (meth)acrylic acid alkyl monomer unit exceeds 33% by mass, the proportion of the styrene-based monomer unit with respect to the (meth) acrylic acid alkyl monomer unit is too little. Thus, the toner to be obtained may be inferior in heat-resistant shelf stability. On the other hand, if the styrene-based monomer unit exceeds 78% by mass and the (meth)acrylic acid alkyl monomer unit is less than 22% by mass, the proportion of the styrene-based monomer unit with respect to the (meth) acrylic acid alkyl monomer unit is too much. Thus, the toner to be obtained may be inferior in low-temperature fixability.

From the viewpoint of maintaining an excellent balance between heat-resistant shelf stability and low-temperature fixability of the toner to be obtained, the content ratio of the styrene-based monomer unit in the copolymer consisting the binder resin is preferably in the range from 70 to 78% by mass, more preferably from 70 to 77% by mass, further more preferably from 71 to 77% by mass. The content ratio of the (meth)acrylic acid alkyl monomer unit is preferably in the range from 22 to 30% by mass, more preferably from 22 to 29% by mass, further more preferably 23 to 29% by mass.

Any polymerizable monomer except the styrene-based monomer and the (meth)acrylic acid alkyl monomer may be used to produce the binder resin. As such a polymerizable monomer, it is preferable to use a monovinyl monomer. Examples of the monovinyl monomer include acrylic acid and methacrylic acid; nitryl compounds such as acrylonitrile and methacrylonitrile; amide compounds such as acrylamide and methacrylamide; and olefins such as ethylene, propylene and butylene. These monovinyl monomers can be used alone or in combination of two or more kinds. If the monovinyl monomer are used, when the total content of the styrene-based monomer and the (meth)acrylic acid alkyl monomer is 100% by mass, the content of the monovinyl monomers is preferably 3% by mass or less.

In order to improve the hot offset and shelf stability, it is preferable to use any crosslinkable polymerizable monomer together with the styrene-based monomer and the (meth) acrylic acid alkyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by mass, preferably from 0.3 to 2 parts by mass, with respect to 100 parts by mass of the styrene-based monomer and the (meth)acrylic acid alkyl monomer.

In the present invention, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269 and C. I. Pigment Violet 19.

In the present invention, these colorants can be used alone or in combination of two or more kinds. The amount of the colorant is preferably in the range from 1 to 10 parts by mass with respect to 100 parts by mass of the styrene-based monomer and the (meth)acrylic acid alkyl monomer.

In the present invention, in order to impart an excellent balance between heat-resistant shelf stability and low-temperature fixability and excellent printing durability in a wide range of temperature and humidity environments to the toner, the retention aid to be used is one in which ($a_1$) a solution obtained by dissolving 1 part by mass of a retention aid in a mixture of 72 parts by mass of styrene and 28 parts by mass of n-butyl acrylate has a interfacial tension $\alpha$ to water that satisfies the following formula (1) and the formula (3) described below and ($a_2$) the glass transition temperature is 60 to 80° C.

$$19.0 \leq \alpha \leq 21.6 \quad \text{Formula (1):}$$

Here, the "solution obtained by dissolving 1 part by mass of a retention aid in a mixture of 72 parts by mass of styrene and 28 parts by mass of n-butyl acrylate (hereinafter also referred to as "retention aid solution")" is a composition which simulates the polymerizable monomer composition having the specific composition and is used for the measurement and evaluation of the interfacial tension. Since the water solubility of styrene and n-butyl acrylate is low, the hydrophilicity of the retention aid in the retention aid solution can be mainly measured by measuring the interfacial tension to water of the retention aid solution.

If the interfacial tension $\alpha$ to water of the retention aid is within the range shown in the formula (1) above, the retention aid is easily present on the surface of the toner. Thus, the continuous printing durability, heat-resistant shelf stability and print quality after storage at high temperatures of the toner obtained by using the retention aid are improved.

However, if the interfacial tension $\alpha$ is less than 19.0 mN/m, the hydrophilicity of the retention aid to the binder resin is too high. Thus, the droplets formed by the following method such as suspension polymerization become unstable. As a result, there is a disadvantage in that the toner particle diameter becomes larger than a predicted value.

If the interfacial tension $\alpha$ exceeds 21.6 mN/m, the amount of the retention aid present on the surface of the toner decreases. Thus, the toner is inferior in heat-resistant shelf stability and the print quality after being left at high temperatures is significantly reduced.

The interfacial tension $\alpha$ is preferably 19.5 to 21.5 mN/m.

As the method for measuring the interfacial tension to water of the retention aid solution, any conventionally known method can be used. For example, by using an automatic contact angle meter (product name: DM-501, manufactured by Kyowa Interface Science Co., LTD.), droplets are formed by dispersing the retention aid solution in ion-exchanged water, and the interfacial tension to water of the droplets cart be measured and calculated. The measurement temperature may be room temperature (15 to 30° C.).

The glass transition temperature Tg of the retention aid is generally 60 to 80° C., preferably from 65 to 77° C., more preferably 70 to 75° C.

One of the purposes to add the retention aid is to intend to improve the heat-resistant shelf stability. However, if the glass transition temperature of the retention aid is less than 60° C., the heat-resistant shelf stability decreases because the glass transition temperature is too low. On the other hand, if the glass transition temperature of the retention aid exceeds 80° C., the low-temperature fixability deteriorate.

The glass transition temperature Tg of the retention aid can be measured with reference to ASTM D3418-82. More specifically, a sample of the retention aid is heated at a heating rate of 10° C./minute by means of Differential Scanning calorimetry (product name: SSC5200; manufactured by SEICO Electronics industrial Co., Ltd.), and the temperature of a maximum endothermic peak in a DSC curve obtained through the above heating process can be defined as the glass transition temperature.

An acid value of the retention aid is preferably 0.3 to 10 mg KOH/g, more preferably 1 to 6 mg KOH/g, further more preferably 1.5 to 4 mg KOH/g. If the acid value of the retention aid is less than 0.3 mg KOH/g, the toner may be poor in heat-resistant shelf stability and low-temperature fixability, and also poor in printing durability in environments ranging from low temperature and low humidity environments to high temperature and high humidity environments. If the acid value of the retention aid exceeds 10 mg KOH/g, desired colored resin particles may not be produced.

The acid value of the retention aid is a value measured with reference to JIS K 0070, i.e., a standard method for analyzing fats and oils enacted by Japanese industrial Standards Committee (JICS).

The weight average molecular weight (Mw) of the retention aid is preferably 6,000 to 50,000, more preferably 7,000 to 45,000, further preferably 9,000 to 40,000.

If the weight average molecular weight (Mw) of the retention aid is less than 6,000, the heat-resistant shelf stability and the durability may deteriorate because the weight average molecular weight is too small. On the other hand, if the weight average molecular weight (Mw) of the retention aid exceeds 50,000, the low-temperature fixability may deteriorate because the weight average molecular weight is too large.

The weight average molecular weight (Mw) of the retention aid can be calculated based on the GPC elution curve obtained by gel permeation chromatography (GPC) measurement of the retention aid or its solution using the calibration curve of the reference material, if appropriate. The GPC measurement conditions are as follows:

Eluate: THF

Flow rate: 0.5 to 3.0 mL/min

Temperature: 25 to 50° C.

The added amount of the retention aid is 1 to 4 parts by mass with respect to 100 parts by mass of the binder resin.

If the added amount of the retention aid is less than 1 part by mass, the effects of the present invention described above, i.e., the effects to exert an excellent balance between heat-resistant shelf stability and low-temperature fixability and excellent printing durability in a wide range of temperature and humidity environments cannot be sufficiently enjoyed because the added amount of the retention aid is too small. If the added amount of the retention aid exceeds 4 parts by mass, the low-temperature fixability decreases.

The added amount of the retention aid is preferably 1.5 to 3.5 parts by mass, more preferably 2.0 to 3.0 parts by mass, with respect to 100 parts by mass of the binder resin.

The retention aid to be used for the present invention is preferably a copolymer of at least one of acrylic acid and methacrylic acid and at least one of acrylic acid ester and methacrylic acid ester (acrylate copolymer). As an acid monomer, acrylic acid is preferable.

In the present invention, any one of a copolymer of acrylic acid ester and acrylic acid, a copolymer of acrylic acid ester and methacrylic acid, a copolymer of methacrylic acid ester and acrylic acid, a copolymer of methacrylic acid ester and methacrylic acid, a copolymer of acrylic acid ester, methacrylic acid ester and acrylic acid, a copolymer of acrylic acid ester, methacrylic acid ester and methacrylic acid and a copolymer of acrylic acid ester, methacrylic acid ester, acrylic acid and methacrylic acid can be used. Among them, the copolymer of acrylic acid ester, methacrylic acid ester and acrylic acid is preferably used in the present invent ion.

A ratio of the acrylic acid ester monomer unit, the methacrylic acid ester monomer unit, the acrylic acid monomer unit, and the methacrylic acid monomer unit in the copolymer is not particularly limited as long as it satisfies the conditions ($a_1$) and ($a_2$).

The ratio of the four kinds of the monomer units can be adjusted by the mass ratio of the added amount of acrylic acid ester, methacrylic acid ester, acrylic acid and methacrylic acid upon synthesizing the copolymer. The mass ratio of the added amount may be, for example, a ratio of (acrylic acid ester and/or methacrylic acid ester): (acrylic acid and/or methacrylic acid)=(99 to 99.95):(0.05 to 1), preferably a ratio of (acrylic acid ester and/or methacrylic acid ester):(acrylic acid and/or methacrylic acid)=(99.4 to 99.9):(0.1 to 0.6), more preferably (acrylic acid ester and/or methacrylic acid ester): (acrylic acid and/or methacrylic acid)=(99.5 to 99.7):(0.3 to 0.5). Among these polymerizable monomers, acrylic acid ester and/or methacrylic acid ester may be substituted by another monomer such as styrene derivatives, nitryl compounds and amide compounds which are exemplified in the monovinyl monomer constituting the binder resin, within the range that does not impair the effect of the present invention. The substituted proportion is 10% by mass or less, more preferably 2% by mass or less, with respect to the total added amount of acrylic acid ester and/or methacrylic acid ester. It is preferable not to be substituted.

Examples of the acrylic acid ester used for the copolymer include methyl acrylate, ethyl acrylate, n-propyl acrylate, isopropyl acrylate, n-butyl acrylate, isobutyl acrylate, sec-butyl acrylate, text-butyl acrylate, n-pentyl acrylate, sec-pentyl acrylate, isopentyl acrylate, neopentyl acrylate, n-hexyl acrylate, isohexyl acrylate, neohexyl acrylate, sec-hexyl acrylate and tert-hexyl acrylate. Among them, preferred are ethyl acrylate, n-propyl acrylate, isopropyl acrylate, and n-butyl acrylate, more preferred is n-butyl acrylate.

Examples of the methacrylic acid ester used for the copolymer include methyl methacrylate, ethyl methacrylate, n-propyl methacrylate, isopropyl methacrylate, n-butyl methacrylate, isobutyl methacrylate, sec-butyl methacrylate, tert-butyl methacrylate, n-pentyl methacrylate, sec-pentyl methacrylate, isopentyl methacrylate, neopentyl methacrylate, n-hexyl methacrylate, isohexyl methacrylate, neohexyl methacrylate, sec-hexyl methacrylate and tert-hexyl methacrylate. Among them, preferred are methyl methacrylate, n-propyl methacrylate, isopropyl methacrylate and n-butyl methacrylate, and more preferred is methyl met acrylate.

The copolymer to be used as the retention aid in the present invention may be a commercially available copolymer, or may be a copolymer produced by a known method such as a solution polymerization method, an aqueous polymerization method, an ionic polymerization method, a high temperature and high pressure polymerization method or a suspension polymerization method.

The typical example of the method for producing the copolymer is as follows. The method for producing the copolymer used in the present invention is not limited to the following typical example.

First, a solvent (as needed) is added to a reactor. The reactor having an atmosphere replaced with an inert atmosphere is heated up. Acrylic acid ester and/or methacrylic acid ester and acrylic acid and/or methacrylic acid as the raw material monomers are added to the reactor. At this time, it is preferable to add a polymerization initiator. Alternatively, it is preferable to gradually add a mixture of the raw material monomers and the polymerization initiator dropwise to the reactor.

Then, the reactor is heated to the temperature at which the polymerization reaction is carried out, and the polymerization is started. The solvent is distilled as needed after the polymerization to obtain a desired copolymer.

In the present invention, in order to impart stable charging ability (charge stability) to the toner, the charge control resin to be used is one in which ($b_1$) a solution obtained by dissolving 1 part by mass of a charge control resin in a mixture of 72 parts by mass of styrene and 28 parts by mass of n-butyl acrylate has a interfacial tension β to water that satisfies the following formula (2) and the formula (3) described below and ($b_2$) the glass transition temperature is 55 to 90° C.

$$13.0 \leq \beta \leq 22.0 \quad \text{Formula (2):}$$

The solution obtained by dissolving 1 part by mass of a charge control resin in a mixture of 72 parts by mass of styrene and 28 parts by mass of n-butyl acrylate (hereinafter also referred to as "charge control resin solution") is a composition which simulates the polymerizable monomer composition having the specific composition and is used for the measurement and evaluation of the interfacial tension. Since the water solubility of styrene and n-butyl acrylate is low, the hydrophilicity of the charge control resin in the charge control resin solution can be mainly measured by measuring the interfacial tension to water of the charge control resin solution.

If the interfacial tension β to water of the charge control resin solution is within the range shown in the formula (2) above, the charge control resin is easily present on the surface of the toner. Thus, the charging ability of the toner obtained by using the charge control resin is easily adjusted. Particularly, the print quality in the high temperature and high humidity (H/H) environment is improved. Further, the heat-resistant shelf stability of the toner is improved and the print quality after being left at high temperatures is also improved.

However, if the interfacial tension β is less than 13.0 mN/m, the hygroscopicity increases. Particularly, the print quality of the toner in the high temperature and high humidity (H/H) environment deteriorates.

If the interfacial tension β exceeds 22.0 mN/m, the amount of the charge control resin present on the surface of the toner decreases. Thus, the charge regulating function of the toner is not sufficiently exerted. As a result, the print quality of the toner deteriorates.

The interfacial tension β is preferably 14.0 to 21.0 mN/m.

The method for measuring the interfacial tension to water of the charge control resin solution is the same as the method for measuring the interfacial tension to water of the retention aid solution.

The glass transition temperature Tg of the charge control resin is generally in the range 55 to 90° C., preferably 60 to 85° C., more preferably 70 to 80° C.

If the glass transition temperature of the charge control resin is less than 55° C., the print quality of the toner after high temperature storage deteriorates. On the other hand, if the glass transition temperature of the charge control resin exceeds 90° C., the fixability of the toner deteriorates.

The method for calculating the glass transition temperature of the charge control resin is the same as the method for calculating the glass transition temperature of the retention aid.

The weight average molecular weight (Mw) of the charge control resin is preferably 4,000 to 50,000, more preferably 5,000 to 25,000, further preferably 7,000 to 20,000. If the weight average molecular weight of the charge control resin is too large, the particle size distribution of the droplets of the monomer composition in the aqueous dispersion medium becomes broad. If the weight average molecular weight is too large, the charge quantity distribution of the toner is wide, and fog is likely to occur in high temperature and high humidity environments. If the weight average molecular weight of the charge control resin is too small, the fluidity of the toner becomes insufficient and the shelf stability also decreases.

The method for calculating the weight average molecular weight (Mw) of the charge control resin is the same as the method for calculating the weight average molecular weight (Mw) of the retention aid.

A proportion of the structural unit, to which the functional group that imparts charging ability has been bonded, in the charge control resin is generally 0.5 to 20% by mass, preferably 1 to 10% by mass. If the proportion of the structural unit is too little, sufficient charging ability is not obtained. If the structural unit is too great, the environmental stability of the toner is likely to deteriorate.

The added amount of the charge control resin in the present invention is 0.1 to 20 parts by mass, with respect to 100 parts by mass of the binder resin. If the added amount of the charge control resin is less than 0.1 part by mass, fog occurs. On the other hand, the added amount of the charge control resin exceeds 20 parts by mass, printing stain occurs.

The added amount of the charge control resin in the present invention is preferably 0.2 to 15 parts by mass, more preferably in the range 0.5 to 5 parts by mass, with respect to 100 parts by mass of the binder resin.

As the charge control resin used in the present invention, a charge control resin having positively charging ability or negatively charging ability is preferably used since the charge control resin is highly compatible with the polymerizable monomer and can impart stable charging ability (charge stability) to the toner particles. From the viewpoint of obtaining a positively-chargeable toner, the charge control resin having positively charging ability is more preferably used, and a charge control resin having positively charging ability which contains a quaternary ammonium salt is further more preferred.

i) Positive Charge Control Resin

The positive charge control resin is preferably a copolymer of a vinyl monomer having a functional group that imparts positively charging ability and another vinyl monomer that is copolymerizable with the vinyl monomer, and may be a polymer obtained by polymerizing a vinyl monomer having no functional group and introducing the functional group by modification. From the viewpoint of compatibility with a binder resin, particularly preferred is a copolymer that contains a monomer unit having a functional group that imparts positively charging ability, a vinyl aromatic hydrocarbon monomer unit and a (meth)acrylate monomer unit. If the positive charge control resin is compatible with a binder resin (polymer of a polymerizable monomer) in a toner, the charging ability of the toner becomes evener. The positive charge control resin is preferably soluble in a styrene-based monomer from the viewpoint of dispersibility in a polymerizable monomer composition.

Examples of the functional group that imparts positively charging ability include a pyridinium group, an amino group, and a quaternary ammonium salt group. The quaternary ammonium salt group is particularly preferred in that it effectively functions even in a non-magnetic one-component developer. A positive charge control resin having a quaternary ammonium salt group has an ionic structure represented by $NR_3^+.X^-$. Three Rs are, independently of one another, a hydrogen atom or a substituent group such as an alkyl group, and X is a halogen atom, a halogenated alkyl group or a hydrocarbon group (alkyl group, aromatic hydrocarbon group, substituted aromatic hydrocarbon group or the like) having $—SO_3^-$, $—PO_3^-$ or $—BO_3^-$.

As the positive charge control resin, preferred is a copolymer having a quaternary ammonium salt group in that the charging ability of the toner becomes even, and more preferred is a copolymer having a vinyl aromatic hydrocarbon monomer unit, a (meth)acrylate monomer unit and a monomer unit having a quaternary ammonium salt group. The quaternary ammonium salt group-containing polymer can be obtained by using the following monomers, polymerizing them by emulsion polymerization, dispersion polymerization, suspension polymerization, solution polymerization or the like in the presence of a polymerization initiator, and then subjecting the resultant polymer to a quaternizing reaction with a proper quaternizing agent as needed.

Specific examples of the vinyl aromatic hydrocarbon monomer include styrene, α-methylstyrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 4-butyl styrene, 4-t-butylstyrene, 2-chlorostyrene, 3-chlorostyrene, 4-chlorostyrene, 2-methyl-α-methylstyrene, 3-methyl-α-methylstyrene and 4-methyl-α-methylstyrene. Among them, styrene and α-methylstyrene are preferred. These vinyl aromatic hydrocarbon monomers may be used alone or in combination of two or more kinds.

Specific example of the acrylate monomer or methacrylate monomer include methyl (meth)acrylate, ethyl (meth) acrylate, propyl (meth)acrylate, isopropyl (meth)acrylate, n-butyl (meth)acrylate, isobutyl (meth)acrylate, n-amyl (meth)acrylate, isoamyl-(meth)acrylate, n-hexyl-(meth) acrylate, 2-ethylhexyl (meth)acrylate, hydroxypropyl (meth) acrylate and lauryl (meth)acrylate. These (meth)acrylate monomers may be used alone or in combination of two or more kinds. A quaternary ammonium salt group-containing (meth)acrylate monomer unit is a structural unit represented by the formula (I).

[Formula 1]

[1]

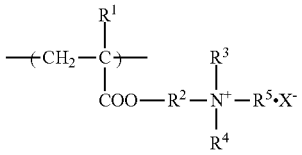

In the above formula (I), $R^1$ is a hydrogen atom or a methyl group, $R^2$ is a linear or branched alkylene group which may be substituted by a halogen and has 1 to 3 carbon atoms, $R^3$ to $R^5$ are, independently of one another, a hydrogen atom or a linear, branched or cyclic alkyl group having 1 to 6 carbon atoms, and X is a halogen atom, or benzene or naphthalene which may have a linear, branched or cyclic alkyl group having 1 to 6 carbon atoms or a halogen atom and has any of $—SO_3^-$, $—PO_3^-$ and $—BO_3^-$.

X is particularly preferably a halogen atom, or a benzenesulfonic acid anion which may have a linear, branched or cyclic alkyl group having 1 to 6 carbon atoms or a halogen atom. Examples of a method for introducing such a quaternary ammonium salt group-containing (meth)acrylate monomer unit into the copolymer include the following methods:

(i) A method in which a vinyl aromatic hydrocarbon monomer, a (meth)acrylate monomer and an N,N-disubstituted aminoalkyl (meth)acrylate monomer are copolymerized in the presence of a polymerization initiator, and the amino group in the resulting copolymer is quaternized with a quaternizing agent such as a halogenated organic compound or acid ester compound;

(ii) A method in which a monomer with an N,N-disubstituted aminoalkyl (meth)acrylate monomer converted into a quaternary ammonium salt, a vinyl aromatic hydrocarbon monomer and a (meth)acrylate monomer are copolymerized in the presence of a polymerization initiator, and the resulting copolymer is then reacted with an organic acid or a derivative thereof to form a salt;

(iii) A method in which a vinyl aromatic hydrocarbon monomer, a (meth)acrylate monomer and a quaternary ammonium salt group-containing (meth)acrylate monomer are copolymerized in the presence of a polymerization initiator; and (iv) A method in which a copolymer of a vinyl aromatic hydrocarbon monomer and a halogenated alkyl (meth)acrylate monomer is mixed with a copolymer of a vinyl aromatic hydrocarbon monomer and an amino group-containing (meth)acrylate monomer to conduct quaternization between the copolymers.

Specific examples of the amino group containing (meth) acrylate monomer include N,N-disubstituted aminoalkyl (meth)acrylates such as dimethylaminomethyl (meth)acrylate, diethylaminomethyl (meth)acrylate, dipropylaminomethyl (meth)acrylate, diisopropylaminomethyl (meth)acrylate, ethylthyamethylaminomethyl (meth)acrylate, methylpropylaminomethyl (meth)acrylate, dimethylamino-1-ethyl (meth)acrylate, diethylamino-1-ethyl (meth)acrylate and dipropylamino-1-ethyl (meth)acrylate. The alkyl group is preferably an alkyl group having 1 to 3 carbon atoms.

The quaternary ammonium salt group-containing (meth) acrylate monomer is a (meth)acrylate compound having the above-described —$NR_3^+.X^-$ structure. Specific examples of the quaternary ammonium salt group-containing (meth) acrylate monomer include N,N,N-trimethyl-N-(2-methacryloxyethyl)ammonium chloride (DMC; dimethylaminoethylmnethyl methacrylate chloride) and N4-benzyl-N,N-dimethyl-N-(2-methacryloxyethyl)ammonium chloride (DML; dimethylaminoehylbenzyl methacrylate chloride). These monomers may also be prepared by modifying an amino group-containing (meth)acrylate monomer with a halogenated organic compound into a halogenated quaternary ammonium salt group-containing (meth)acrylate monomer.

Examples of the quaternizing agent include halogenated organic compounds and acid ester compounds. Examples of the halogenated organic compounds include linear, branched or cyclic alkyl halides having 1 to 6 carbon atoms, such as chloromethane, dichloromethane and trichloromethane; and aromatic halides such as chlorobenzene, 4-chlorotoluene and 1-chloronaphthalene. Examples of the acid esters include alkyl sulfonic acid alkyl esters such as methyl methanesulfonate and ethyl methanesulfonate; benzenesulfonic acid alkyl esters such as methyl benzene sulfonate; alkyl p-toluenesulfonates such as methyl p-toluenesulfonate; phosphate esters such as trimethyl phosphate; and borate esters such as trimethoxyborane.

Examples of the organic acid or the derivative thereof include alkylsulfonic acids such as methylsulfonic acid; aromatic sulfonic acids such as benzenesulfonic acid and p-toluenesulfonic acid; phosphate esters such as trimethyl phosphate; and borate esters such as trimethoxyborane.

ii) Negative Charge Control Resin

As the negative charge control resin, preferred is a polymer having a sulfonic acid group from the viewpoints of dispersion stability of droplets of the polymerizable monomer composition, the charge controlling ability of the resulting toner, image quality, etc., more preferred is a copolymer having a structural unit derived from a sulfonic acid group-containing (meth)acrylate monomer and a structural unit derived from another polymerizable monomer, and particularly preferred is a copolymer having a structural unit derived from a sulfonic acid group-containing (meth)acrylamide monomer, a structural unit derived from a vinyl aromatic hydrocarbon monomer and a structural unit derived from a (meth)acrylate monomer. Such a copolymer can be obtained by polymerizing a sulfonic acid group-containing (meth)acrylamide monomer, a vinyl aromatic hydrocarbon monomer and a (meth)acrylate monomer by emulsion polymerization, dispersion polymerization, suspension polymerization, solution polymerization or the like using a polymerization initiator. Among them, the solution polymerization method is preferred in that a copolymer having the intended weight average molecular weight is easy to obtain. As the polymerization method, the same method as that used in the positive charge control resin may be adopted.

Specific examples of the vinyl aromatic hydrocarbon monomer and (meth)acrylate monomer used herein are common to the case of the positive charge control resin. Specific examples of the sulfonic acid group-containing (meth)acrylamide monomer include acrylamidealkylsulfonic acids such as 2-acrylamido-1-methylpropanesulfonic acid, 2-acrylamido-2-methylpropanesulfonic acid, 2-acrylamido-n-butanesulfonic acid, 2-acrylamido-n-hexanesulfonic acid, 2-acrylamido-n-octanesulfonic acid, 2-acrylamido-n-dodecanesulfonic acid, 2-acrylamido-n-tetradecanesulfonic acid, 2-acrylamido-2-methylpropanesulfonic acid, 2-acrylamido-2-phenylpropanesulfonic acid, 2-acrylamido-2, 2,4-trimethylpentanesulfonic acid, 2-acrylamido-2-methyliphenylethantesulforic acid, 2-acrylamido-2-(4-chlorophenyl)propanesulfonic acid, 3-acrylamido-3-methylbutanesulfonic acid, 2-methacrylamido-n-decanesulfonic acid and 4-methacrylamidobenzenestulfonic acid; acrylamidocarboxyalkylsulfonic acids such as 2-acrylamido-2-carboxymethylpropanesulfonic acid; acrylamido-heterocyclic group-containing alkylsulfonic acids such as 2-acrylamido-2-(2-pyridine)propanesulfonic acid; and metal salts thereof. These sulfonic acid group-containing (meth) acrylamide monomers may be used alone or in combination of two or more kinds.

The polymerization method is not particularly limited. The solution polymerization method is preferred in that a copolymer having the intended weight average molecular weight is easy to obtain. Examples of the solvent include aromatic hydrocarbons such as benzene and toluene; saturated hydrocarbons such as n-hexane and cyclohexane; alcohols such as methanol, ethanol, and isopropyl alcohol; nitrogen-containing organic compounds such as nitriles, amines, amides and heterocyclic compounds; oxygen-containing organic compounds such as ketones, carboxylic acid esters, ethers and carboxylic acids; chlorine-containing organic compounds such as chlorine-substituted aliphatic hydrocarbons; and sulfur-containing organic compounds. As the polymerization initiator, used is an azo compound, a peroxide or the like used in the suspension polymerization of a polymerizable monomer, which will be described below. With respect to polymerization conditions, the polymerization temperature is generally 50 to 200° C., and the polymerization time is generally 0.5 to 20 hours.

The charge control resin in the present invention may be synthesized from a monomer by known methods, or may be prepared by drying of any conventional charge control resin.

Examples of the conditions of drying of the conventional charge control resin include the conditions of drying at a temperature of 35 to 80'C and a pressure of 0.5 to 20 kpa for 10 minutes to 24 hours.

Specific examples of the conventional charge control resin which can be used for the present invention through the drying include Acrylic Base FCA-592P (product name: manufactured by FUJIKURA KASEI CO., LTD.), Acrylic Base FCA-681P (product name: manufactured by FUJIKURA KASEI CO., LTD.), Acrylic Base FCA-626N (product name: manufactured by FUJIKURA KASEI CO., LTD.), and Acrylic Base FCA-207P (product name: manufactured by FUJIKURA KASEI CO., LTD.)

In the present invention, in addition to the conditions ($a_1$) and ($a_2$) and the conditions ($b_1$) and ($b_2$), one of the characteristics is that (c) the interfacial tension α and the interfacial tension β satisfy the following formula (3):

$$-1.0 \leq \alpha - \beta \leq 7.0 \quad \text{Formula (3):}$$

If (α−β) is less than −1.0 mN/m, the charge control resin is easily present inside the toner, compared to the retention aid. The charge controlling function cannot be sufficiently exerted. Thus, particularly the print quality of the toner in the high temperature and high humidity (H/H) environment deteriorates. Further, the amount of the retention aid present on the surface of the toner increases, which causes a deterioration in low-temperature fixability.

On the other hand, if (α−β) exceeds 7.0 mN/m, the affinity of the retention aid for the charge control resin decreases. Thus, the retention aid is not easily present on the surface of the toner. The continuous printing durability, heat-resistant shelf stability and print quality after being left at high temperatures deteriorate.

(α−β) is preferably −0.5 to 6.5, more preferably −0.3 to 5.5.

From the viewpoint of improving the releasing characteristics of the toner from a fixing roller at fixing, the release agent is added to the polymerizable monomer composition. The release agent can be used without any particular limitation as long as it is generally used as a release agent for the toner.

The release agent preferably contains an ester wax. The use of this wax as the release agent allows the balance between low-temperature fixability and shelf stability to be improved.

Examples of the ester wax suitably used as the release agent in the present invention include polyfunctional ester waxes including: pentaerythritol ester compounds such as pentaerythritol tetrapalmitate, pentaerythritol tetrabehenate, pentaerythritol tetrastearate, glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate and glycerintribehenate, and dipentaerythritol ester compounds such as dipentaerythritol hexamyristate and dipentaerythritol hexapalmitate, and monoester waxes such as eicosyl palmitate, stearyl stearate, hexadecyl eicosanoate, behenyl palmitate, eicosyl stearate, stearyl eicosanoate, hexadecyl behenate, behenyl stearate, eicosyl eicosanoate, stearyl behenate and hexadecyl lignocerate. Among them, preferred are monoester waxes. Among the monoester waxes, preferred are behenyl stearate, eicosyl eicosanoate, stearyl behenate, and hexadecyl lignocerate, and more preferred is behenyl stearate.

As the release agent in the present invention, a hydrocarbon wax can be used. Examples of the hydrocarbon wax include a polyethylene wax, a polypropylene wax, a Fischer-Tropsch wax and a petroleum wax. Among them, preferred are a Fischer-Tropsch wax and a petroleum wax, more preferred is a petroleum wax.

The number average molecular weight of the hydrocarbon wax is preferably 300 to 800, more preferably 400 to 600. The penetration of the hydrocarbon wax measured in accordance with JIS K2235 5.4 is preferably 1 to 10, more preferably 2 to 7.

In addition to the release agents, natural waxes such as jojoba wax; and mineral waxes such as ozokerite can be used.

The release agent may be used in combination of two or more kinds of the waxes.

The amount of the release agent to be used is preferably 0.1 to 30 parts by mass, more preferably 1 to 20 parts by mass, with respect to 100 parts by mass of the styrene-based monomer and the (meth)acrylic acid alkyl monomer.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range 0.01 to 10 parts by mass, more preferably 0.1 to 5 parts by mass, with respect to 100 parts by mass of the styrene-based monomer and the (meth)acrylic acid alkyl monomer.

(A-2) Suspension Process of Obtaining Suspension (Droplets Forming Process)

In the present invention, it is preferable that the polymerizable monomer composition including at least a polymerizable monomer, a colorant, a release agent, a retention aid and a charge control resin is dispersed, preferably in an aqueous medium containing a dispersion stabilizer, and a polymerization initiator is added therein. Then, the droplets of the polymerizable monomer composition are formed. The method for forming droplets is not particularly limited. The droplets are formed by means of a device capable of strong stirring such as an in-line type emulsifying and dispersing machine (product name: MILDER; manufactured by Pacific Machinery & Engineering Co., Ltd), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxydiethylacetate, t-hexylperoxy-2-ethylbutanoate, diisopropylperoxydicarbonate, di-t-butylperoxyisophthalate and t-butylperoxyisobutyrate. These can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce a residual polymerizable monomer.

The polymerization initiator may be added after dispersing the polymerizable monomer composition to the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably 0.1 to 20 parts by mass, more preferably 0.3 to 15 parts by mass, further more preferably 1 to 10 parts by mass, with respect to 100 parts by mass of the styrene-based monomer and the (meth)acrylic acid alkyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants: and ampholytic surfactants. These dispersion stabilizers can be used alone or in combination of two or more kinds.

Among the above dispersion stabilizers, colloid of inorganic compounds, particularly hardly water-soluble metal hydroxide, is preferable. By using the colloid of inorganic compounds, particularly hardly water-soluble metal hydroxide, the colored resin particles can have a small particle size distribution, so that the amount of the dispersion stabilizer remained after washing is small, thus the image can be clearly reproduced by the toner to be obtained; moreover, environmental stability can be excellent.

(A-3) Polymerization Process

After the droplets are formed as described in the above (A-2), thus obtained aqueous dispersion medium is heated to polymerize. Thereby, an aqueous dispersion of colored resin particles is formed.

The polymerization temperature of the polymerizable monomer composition is preferably 50° C. or more, more preferably 60 to 95° C. The polymerization reaction time is preferably 1 to 20 hours, more preferably 2 to 15 hours.

The colored resin particle may be used as a polymerized toner obtained by adding an external additive. It is preferable that the colored resin particle is so-called core-shell type (or "capsule type") colored resin particle which is obtained by using the colored resin particle as a core layer and forming a shell layer, a kind of which is different from that of the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous medium to which the colored resin particles are dispersed followed by polymerization, thus the core-shell type colored resin particles can be obtained.

As the polymerizable monomer for shell, the above-mentioned polymerizable monomer can be similarly used. Among the polymerizable monomers, any of monomers which provide a polymer having Tg of more than 80° C. such as styrene, acrylonitrile and methyl methacrylate is preferably used alone or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl-2-hydroxyethyl) propionamide). These polymerization initiators can be used alone or in combination of two or more kinds. The amount of the polymerization initiator is preferably 0.1 to 30 parts by mass, more preferably 1 to 20 parts by mass, with respect to 100 parts by mass of the polymerizable monomer for shell.

The polymerization temperature of the shell layer is preferably 50° C. or more, more preferably 60 to 95° C. The polymerization reaction time is preferably 1 to 20 hours, more preferably 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying several times as needed after the polymerization, according to any conventional method.

In the washing method, if the inorganic compound is used as the dispersion stabilizer, it is preferable that acid or alkali is added to the aqueous dispersion of colored resin particles; thereby, the dispersion stabilizer is dissolved in water and removed. If colloid of hardly water-soluble inorganic hydroxide is used as the dispersion stabilizer, it is preferable to control pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the following processes are performed.

First, a binder resin, a colorant, a release agent, a retention aid, a charge control resin and other additives such as a molecular weight modifier etc., which are added if required, are mixed by means of a mixer such as a ball mill, a V type mixer, FM mixer (product name, manufactured by NIPPON COKE & ENGINEERING. CO., LTD.), a high-speed dissolver or an internal mixer. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant, the release agent, the retention aid, the charge control resin and other additives such as the molecular weight modifier etc., which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the above production method such as (A) Suspension polymerization method or (B) Pulverization method.

Hereinafter, the colored resin particles constituting the toner will be described. The colored resin particles hereinafter include both core-shell type colored resin particles and colored resin particles which are not core-shell type.

The colored resin particles obtained by the above production method contain 1 to 4 parts by mass of the retention aid and 0.1 to 20 parts by mass of the charge control resin, with respect to 100 parts by mass of the binder resin.

The volume average particle diameter (Dv) of the colored resin particles is preferably 4 to 12 μm, more preferably 5 to 10 μm. If the volume average particle diameter (Dv) of the colored resin particles is less than 4 μm, the flowability of the polymerized toner may lower, the transferability may deteriorate, and the image density may decrease. If the volume average particle diameter (Dv) of the colored resin particles exceeds 12 μm, the resolution of images may decrease.

As for the colored resin particles, a ratio (particle size distribution (Dv/Dn)) of the volume average particle diameter (Dv) and the number average particle diameter (Dn) is preferably 1.00 to 1.20, more preferably 1.00 to 1.15. If "Dv/Dn" exceeds 1.20, the transferability, image density and resolution may decrease. The volume average particle diameter and the number average particle diameter of the colored resin particles can be measured, for example, by means of a particle diameter measuring device (product name: MULTISIZER; manufactured by Beckman Coulter, Inc.), etc.

3. Method for Mixing Colored Resin Particles with External Additive

Although the colored resin particles described above can be used as a toner as they are, it is preferable that the colored resin particles are mixed and agitated together with an external additive; thus, the external additive is uniformly and suitably attached (externally added) on the surface of the colored resin particles, and the resultant particles are used as a toner. The one-component toner may be mixed and agitated together with carrier particles to form a two-component developer.

The agitator for adding an external additive to colored resin particles is not particularly limited as long as it is an agitator capable of attaching the external additive on the surface of the colored resin particles. The examples include agitators capable of mixing and agitating such as FM Mixer (product name; manufactured by NIPPON COKE & ENGINEERING CO., LTD.), SUPER MIXER (product name; manufactured by KAWATA Manufacturing Co., Ltd.), Q MIXER (product name; manufactured by NIPPON COKE & ENGINEERING CO., LTD.), Mechanofusion system (product name; manufactured by Hosokawa Micron Corporation) and MECHANOMILL (product name; manufactured by Okada Seiko Co., Ltd.)

Examples of the external additive include: inorganic particles including silica, titanium oxide, aluminum oxide, zinc oxide, tin oxide, calcium carbonate, calcium phosphate and/or cerium oxide; and organic particles including polymethyl methacrylate, silicone resin and/or melamine resin. Among them, inorganic particles are preferable. Among the inorganic particles, silica and/or titanium oxide is preferable, and particles including silica are more preferable.

These external additives are used alone, or in combination of two or more kinds. In particular, it is preferable to use two or more kinds of silica having a different particle diameter in a combination.

In the present invention, it is desirable that the amount of the external additive to be used is generally 0.05 to 6 parts by mass, preferably 0.2 to 5 parts by mass, with respect to 100 parts by mass of the colored resin particles. If the added amount of the external additive is less than 0.05 part by mass, the toner after transfer may be remained. If the added amount of the external additive exceeds 6 parts by mass, fog may occur.

The toner of the present invention is produced by using the binder resin which is a copolymer containing a polymerizable monomer unit having a specific composition within a specific range in combination with the retention aid and the charge control resin which have specific physical properties so that the toner has an excellent balance between heat-resistant shelf stability and low-temperature fixability, is excellent in durability during regular use and after being left at high temperatures, and can suppress the occurrence of fogging in a high temperature and high humidity environment.

EXAMPLES

Hereinafter, the present invention will be described further in detail with reference to examples and comparative examples. However, the scope of the present invention may not be limited to the following examples. Herein, "part(s)" and "%" are based on mass if not particularly mentioned.

Test methods used in the examples and the comparative examples are as follows.

1. Production of Copolymer

Production Example 1

200 parts of toluene was added into a reactor. Its inside was sufficiently replaced with nitrogen while stirring toluene. Then, the reactor was heated to 90° C. After that, a mixture of 97 parts of methyl methacrylate, 2.6 parts of n-butyl acrylate, 0.4 part of acrylic acid, and 3 parts of t-butylperoxy-2-ethylhexanoate (product name: Perbutyl O, manufactured by NOF CORPORATION.) was added dropwise to the reactor for 2 hours. Further, the resultant mixture was maintained under toluene reflux for 10 hours to complete polymerization and the solvent was distilled off under reduced pressure. The thus obtained copolymer is referred to as "copolymer 1". The characteristics of the obtained copolymer 1 are shown in Table 1.

Production Examples 2 to 9

Copolymers 2 to 9 were produced similarly as in Production example 1 except that, in Production example 1, the composition ratio of the monomers to be used and the amount of the initiator were changed to those shown in Table 1. The characteristics of the obtained copolymers 2 to 9 are shown in Table 1.

2. Production of Positive Charge Control Resin

Production Example 10

88 parts of styrene, 10 parts of n-butyl acrylates, and 2 parts of N,N-diethyl-N-methyl-N-(2-methacryloylethyl)ammonium p-toluenesulfonate were put into a mixed solvent of 500 parts of toluene and 400 parts of methanol and reacted at 80° C. for 8 hours in the presence of 4 parts of 2,2'-azobis dimethylvaleronitrile. After the completion of the reaction, the solvent was distilled away to obtain a quaternary ammonium salt group-containing copolymer (hereinafter, referred to as "charge control resin 1"). The obtained charge control resin 1 had a weight average molecular weight of 12,200 and a glass transition temperature of 75.4° C.

Production Examples 11 to 17

Charge control resins 2 to 8 were produced similarly as in Production example 10 except that, in Production example 10, the composition of monomers to be used was changed to that shown in Table 2. The characteristics of the obtained charge control resins 2 to 8 are shown in Table 2.

3. Characteristics of Raw Materials

The interfacial tension, glass transition temperature, and weight average molecular weight (Mw) of the copolymers 1 to 9 and the charge control resins 1 to 8 were measured. The acid value of each of the copolymers 1 to 9 was also measured.

(1) Interfacial Tension of Solution Containing Copolymer or Charge Control Resin 1 part of the copolymer or 1 part of the charge control resin was dissolved in 72 parts of styrene and 28 parts of n-butyl acrylate. The interfacial tension to water of the obtained solution was measured.

Specifically, an automatic contact angle meter (product name: DM-501, manufactured by Kyowa Interface Science Co., LTD.) was used, the lens field of view was adjusted to WIDE2, and the measurement was performed at temperature of 25° C. A needle extending downward in the vertical direction was used. The inner diameter of the needle was changed as needed depending on the sample. The tip of the needle was placed in the solution to be measured. Subsequently, the needle was connected to the syringe. Degassed ion-exchanged water was placed in the syringe. The ion-exchanged water was ejected from the needle of the syringe to form droplets at the tip of the needle in the solution. The interfacial tension was calculated based on the shape of each of the droplets using multifunctional integrated analysis software FAMAS. A density difference between water and the solution needed for calculation was 0.10 g/cm$^3$. The final measurement result of the interfacial tension was an average of the values measured ten times. The results of the obtained interfacial tension are shown in Tables 1 and 2.

(2) Glass Transition Temperature of Copolymer and Charge Control Resin

The maximum endothermic peak temperature (the temperature exhibiting the maximum endothermic peak) of a copolymer or a charge control resin was measured with reference to ASTM D3418-82. More specifically, the copolymer was heated at a heating rate of 10° C./minute and the temperature exhibiting the maximum endothermic peak in a DSC curve obtained through the above heating process was measured by means of Differential Scanning calorimetry (product name: SSC5200; manufactured by SEICO Electronics industrial Co., Ltd.) The temperature was used as the glass transition temperature (Tg) of the copolymer. The results of the obtained glass transition temperature (Tg) are shown in Tables 1 and 2.

(3) Weight Average Molecular Weight (Mw) of Copolymer and Charge Control Resin

Samples (0.1 g) were weighed out and placed in 100 mL glass sample bottles. 49.9 g of THF was placed in each of the bottles. A stirrer chip was placed in each of the bottles and stirred at room temperature for 1 hour by means of a magnetic stirrer. Then, the resultant solutions were each filtered with a 0.2 μm thick PTFE filter to obtain copolymer THF solutions. Finally, 100 μL of each of the THF solutions was injected into a GPC measuring device to measure GPC. The weight average molecular weight (Mw) was calculated from a calibration curve in terms of commercially available monodisperse standard polystyrene, based on the elution curve of each of the obtained GPCs. The results of the obtained weight average molecular weight (Mw) are shown in Tables 1 and 2.

(GPC Measurement Condition)

GPC: HLC-8220 (manufactured by TOSOH CORPORATION)

Column: Two directly connected columns of TSK-GEL MULTIPORE HXL-M (manufactured by TOSOH CORPORATION)

Eluate: THF

Flow rate: 1.0 mL/min

Temperature: 40° C.

(4) Acid Value of Copolymer

The acid value of each copolymer was measured with reference to JIS K 0070, i.e., a standard method for analyzing fats and oils enacted by Japanese Industrial Standards Committee (JICS). The obtained acid values are shown in Table 1.

The composition and characteristics of the copolymers 1 to 9 are summarized in the following table 1. In the following table 1, "AA (part)", "MAA (part)", "MA (part)", "EA (part)", "BA (part)" and "Initiator (part)" each represent the added amount of each of acrylic acid, methacrylic acid, methyl methacrylate, ethyl acrylate, n-butyl acrylate and t-butylperoxy-2-ethylhexanoate (polymerization initiator).

The composition and characteristics of the charge control resins 1 to 8 are summarized in the following table 2. In the following table 2, "ST (part)", "BA (part)" and "Functional group monomer (part)" each represent the added amount of each of styrene and n-butyl acrylate and N,N-diethyl-N-methyl-N-(2-methacryloylethyl)ammonium p-toluenesulfonate (functional group monomer).

TABLE 1

| | Copolymer 1 | Copolymer 2 | Copolymer 3 | Copolymer 4 | Copolymer 5 | Copolymer 6 | Copolymer 7 | Copolymer 8 | Copolymer 9 |
|---|---|---|---|---|---|---|---|---|---|
| AA (part) | 0.4 | 0.2 | 0.1 | 0.9 | 1.5 | 0.4 | — | 0.4 | 0.4 |
| MAA (part) | — | — | — | — | — | — | 0.4 | — | — |
| MMA (part) | 97.0 | 97.2 | 97.3 | 96.7 | 96.0 | 96.2 | 96.2 | 84.0 | 97.0 |
| EA (part) | — | — | — | — | — | 3.5 | — | — | — |
| BA (part) | 2.6 | 2.6 | 2.6 | 2.4 | 2.5 | — | 2.6 | 15.6 | 2.6 |
| Initiator (part) | 3 | 3 | 3 | 3 | 3 | 3 | 3 | 3 | 2 |
| Interfacial tension α(mN/m) | 20.7 | 21.5 | 21.8 | 19.5 | 18.4 | 20.8 | 20.8 | 20.4 | 21.0 |
| Tg(° C.) | 75.2 | 75.3 | 75.7 | 75.8 | 75.6 | 74.6 | 75.7 | 55.6 | 68.4 |
| Mw | 9700 | 9800 | 10200 | 9800 | 9900 | 10000 | 9600 | 9800 | 15300 |
| Acid value (mg KOH/g) | 2.6 | 0.8 | 0.3 | 5.9 | 9 | 2.4 | 2.4 | 2.3 | 2.3 |

TABLE 2

| | Charge control resin 1 | Charge control resin 2 | Charge control resin 3 | Charge control resin 4 | Charge control resin 5 | Charge control resin 6 | Charge control resin 7 | Charge control resin 8 |
|---|---|---|---|---|---|---|---|---|
| ST (part) | 88.0 | 86.0 | 83.0 | 87.5 | 88.0 | 81.0 | 89.0 | 76.0 |
| BA (part) | 10.0 | 10.0 | 9.0 | 11.0 | 11.0 | 7.0 | 7.0 | 20.0 |
| Functional group monomer (part) | 2.0 | 4.0 | 8.0 | 1.5 | 1.0 | 12.0 | 4.0 | 4.0 |
| Interfacial tension β(mN/m) | 19.8 | 17.1 | 14.3 | 21.0 | 23.0 | 12.6 | 17.4 | 16.3 |
| Tg(° C.) | 75.4 | 73.7 | 73.3 | 74.2 | 74.8 | 74.2 | 81.7 | 53.3 |
| Mw | 12200 | 11800 | 11400 | 12100 | 12400 | 11100 | 12900 | 10300 |

4. Production of Toner

Example 1

70 parts of styrene and 30 parts of n-butyl acrylate as monovinyl monomers, 7 parts of carbon black (product name: #25B; manufactured by Mitsubishi Chemical Corporation) as a black colorant, 0.7 part of divinylbenzene as a crosslinkable polymerizable monomer, 1.0 part of t-dodecyl mercaptan as a molecular weight modifier, and 2 parts of the copolymer 1 obtained in Production example 1 as a retention aid were wet-pulverized by means of a media type wet pulverizer. Thereto, 1 part of the charge control resin 1 obtained in Production example 10 as a charge control agent, and 20 parts of behenyl stearate (molecular formula: $C_{27}H_{35}CO_2C_{22}H_{45}$, melting point: 70° C., acid value: 0.1 mg KOH/g, hydroxyl value: 0.37 mg KOH/g) as a release agent were added and mixed. Thus, a polymerizable monomer composition was obtained.

Separately, in an agitating chamber, a solution containing 4.1 parts of sodium hydroxide dissolved in 50 parts of ion-exchanged water was gradually added to a solution containing 7.4 parts of magnesium chloride dissolved in 250 parts of ion-exchanged water at room temperature while agitating to prepare a magnesium hydroxide colloid dispersion (3.0 parts of magnesium hydroxide).

The polymerizable monomer composition was charged into the above-obtained magnesium hydroxide colloid dispersion and agitated at room temperature until the droplets were stable. 5 parts of t-butylperoxy-2-ethylhexanoate (product name: PERBUTYL O; manufactured by NOF Corporation) as a polymerization initiator was added therein, followed by being subjected to a high shear agitation at 15,000 rpm by means of an in-line type emulsifying and dispersing machine (product name: MILDER; manufactured by Pacific Machinery & Engineering Co., Ltd). Thus, droplets of the polymerizable monomer composition were formed.

The suspension having the above-obtained droplets of the polymerization monomer composition dispersed (a polymerizable monomer composition dispersion) was charged into a reactor furnished with an agitating blade and the temperature thereof was raised to 90° C. to start a polymerization reaction. When the polymerization conversion reached almost 100%, 1.5 parts of methyl methacrylate (a polymerizable monomer for shell) and 0.10 part of 2,2'-azobis(2-methyl-N-(2-hydroxyethyl)-propionamide) (a polymerization initiator for shell; product name: VA-086; manufactured by Wako Pure Chemical Industries, Ltd.; water-soluble) dissolved in 20 parts of ion-exchanged water were added into the reactor. After continuing the polymerization for another 3 hours at 90° C., the reactor was cooled by water to stop the reaction. Thus, an aqueous dispersion of colored resin particles was obtained.

The above-obtained aqueous dispersion of colored resin particles was subjected to acid washing, in which sulfuric acid was added dropwise to be pH of 6.5 or less while agitating at room temperature. Then, separation by filtration was performed, and thus a solid content was obtained. After 500 parts of ion-exchanged water was added to the solid content to make a slurry again, a water washing treatment (washing, filtration and dehydration) was performed several times. Next, separation by filtration was performed and the thus-obtained solid content was placed in a container of a dryer for drying at 45° C. for 48 hours. Thus, dried colored resin particles were obtained.

To 100 parts of the above-obtained colored resin particles, were added 0.7 part of silica particles A having a number average primary particle diameter of 10 nm and 1 part of silica particles B having a number average primary particle diameter of 55 nm, which had been hydrophobized with amino modified silicone oil, to mix by means of a high speed agitator (product name: FM Mixer; manufactured by NIPPON COKE & ENGINEERING CO., LTD.), and the external additives were externally added. Thus, a toner of Example 1 was produced. The test results are shown in Table 1.

Examples 2 to 11 and Comparative Examples 1 to 9

Toners of Examples 2 to 11 and Comparative Examples 1 to 9 were produced similarly as in Example 1 except that, in Example 1, the kind and/or added amount as for the copolymer and/or charge control resin were changed to those shown in Tables 3 and 4.

Example 12

A toner of Example 12 was produced similarly as in Example 2 except that, in the production of the toner of Example 2, 75 parts of styrene and 25 parts of n-butyl acrylate were used as monovinyl monomers in place of 70 parts of styrene and 30 parts of n-butyl acrylate. The copolymer (retention aid) and charge controlling agent used in Example 12 were the same as those in Example 2.

5. Evaluation of Properties of Colored Resin Particles and Toners

The properties of the toners of Examples 1 to 12 and Comparative Examples 1 to 9 and the colored resin particles used in the toners were examined. The details are as follows. The evaluation results are shown in Tables 3 to 5.

(1) Measurement of Particle Diameter of Colored Resin Particles

The volume average particle diameter Dv, number average particle diameters Dp, and particle size distribution Dv/Dp of the colored resin particles were measured with a particle diameter measuring device (product name: MULTISIZER; manufactured by Beckman Coulter, Inc.). The measurement using the MULTISIZER was conducted under the conditions of: aperture diameter: 100 μm; dispersion medium: ISOTON II (product name); concentration: 10%; and number of the measured particles: 100,000.

Specifically, 0.2 g of a colored resin particle sample was place in a beaker. Then, a solution of alkyl benzene sulfonate (product name: DRIWEL: manufactured by FUJIFILM Corporation) was added therein as a dispersant. Further, 2 mL of the dispersion medium was added to the beaker to allow the colored resin particles to be wet. Then, 10 mL of the dispersion medium was added to the beaker and the colored resin particles were dispersed with an ultrasonic disperser for 1 minute. After that, the measurement using the particle diameter measuring device was performed.

(2) Heat-Resistant Temperature of Toner 10 g of a toner was placed in a 100 mL polyethylene container and the container was sealed. Then, the container was set in a constant temperature water bath which was set to a predetermined temperature. After 8 hours, the container was removed from the constant temperature water bath. The toner was transferred from the removed container to a 42-mesh sieve in a manner preventing vibration as much as possible, then was set in a powder characteristic tester (product name: POWDER TESTER PT-R; manufactured by Hosokawa Micron Corporation). The condition of amplitude of the sieve was set to 1.0 mm, the sieve was vibrated for 30 seconds, and the mass of the toner remained on the sieve was measured and the thus-measured toner was referred to as an aggregated toner mass.

The maximum temperature at which the aggregated toner mass becomes 0.5 g or less was determined as the heat-resistant temperature of the toner.

6. Printing Evaluation of Toner

Printing Properties of the toners of Examples 1 to 12 and Comparative examples 1 to 9 were examined. The details are as follows. The evaluation results are shown in Tables 3 to 5.

(1) Measurement of Fixing Temperature of Toner

A commercially available printer of the non-magnetic one-component developing method (resolution: 600 dpi, printing speed: 28 sheets/min), which was refurbished so that the temperature of a fixing roller of the printer was changed, was used for a fixing test. In the fixing test, the temperature of the fixing roller in the refurbished printer was changed, and then the fixing rate of the toner was measured at each temperature.

The fixing rate was calculated from a ratio of image densities before and after an operation of removing a tape from a black solid area that has been printed on a test paper by the refurbished printer. In particular, if the image density before removing the tape is referred to as ID (before) and the image density after removing the tape is referred to as ID (after), the fixing rate can be calculated from the following formula:

$$\text{Fixing rate (\%)}=(\text{ID(after)}/\text{ID(before)})\times 100$$

Tape removing operation means a series of operations including: attaching an adhesive tape (product name: SCOTCH MENDING TAPE 810-3-18; manufactured by Sumitomo 3M Limited) to a measuring part of a test paper (the area of the solid patterned image) to be adhered by pressure at a constant pressure; and removing the adhesive tape in a direction along the paper at a constant rate. The image density was measured by means of a spectrophotometer (product name: SpectroEye, manufactured by X-Rite Incorporated). In the above fixing test, the minimum fixing roller temperature at which the fixing rate is 80% or more was referred to as the minimum fixing temperature of the toner.

(2) Printing Durability Test in Normal Temperature and Normal Humidity (N/N) Environment Printing sheets were set in the same printer described in (1) Measurement of Fixing Temperature of Toner and a toner was charged in a development device of the printer. The printer was left to stand for 24 hours under a normal-temperature and normal-humidity (N/N) environment of 23° C. in temperature and 50% RH in humidity. Then, under the same environment, continuous printing was conducted to 20,000 sheets of paper at a printing density of 5%. Black solid printing (printing density 100%) was conducted every 500 sheets of paper, and the printing density of a solid printed area was measured by means of a spectrophotometer (product name: SpectroEye, manufactured by X-Rite Incorporated). Thereafter, white solid printing (0% printing density) was performed, and the printer was stopped in the middle of the white solid printing. The toner in a non-image area on the photoconductor after development was attached on an adhesive tape ("Scotch Mending Tape 810-3-18" manufactured by Sumitomo 3M Limited). Then, the tape was attached to a printing sheet. Thereafter, a whiteness degree (B) of the printing sheet, on which the adhesive tape had been attached, was measured by means of a whiteness meter (manufactured by Nippon Denshoku Industries Co., Ltd.). Only an unused adhesive tape was attached on the printing sheet to measure a whiteness degree (A) thereof likewise. The difference (B−A) between these whiteness degrees was regarded as a fog value (%). The smaller value indicates that fog is less, and image quality is better.

The number of printing sheets, on which the continuous printing could be conducted while retaining such image quality that the printing density is 1.3 or higher, and the fog value is 5% or lower, was determined.

(3) Printing Durability Test in Normal Temperature and Normal Humidity (N/N) Environment after being Left at High Temperature Printing sheets were set in the same printer described in (1) Measurement of Fixing Temperature of Toner and a toner was charged in a development device of the printer. The printer was left to stand for 120 hours under environment of 50° C. in temperature. Then, under a normal temperature and normal humidity (N/N) environment at a temperature of 23° C. and a relative humidity of 50%, the same test described in (2) Printing Durability Test was performed.

(4) Fog Evaluation in High Temperature and High Humidity (H/H) Environment

A commercially available printer of the non-magnetic one-component developing method and the toner to be evaluated were left for a whole day and night in a high temperature and high humidity (H/H) environment at a temperature of 35° C. and a humidity of 80%.

The fog evaluation was performed in the following manner. First, the color tone of a printing sheet unused for printing was measured, and this color tone was used as a reference value ($E_0$). Next, the toner was used to perform white solid printing on the printing sheet with the same printer described in (1) Measurement of Fixing Temperature of Toner. Color tones ($E_1$ to $E_6$) of 6 areas of the white solid part were measured. A color difference (ΔE) between each of the color tones ($E_1$ to $E_6$) and the reference ($E_0$) was calculated. The largest color difference ΔE was used as the fog value of the toner. The smaller fog value indicates that fog is less, and image quality is better. The color tone was measured with the spectrophotometer.

The evaluation results of the toners of Examples 1 to 12 and Comparative examples 1 to 9 are shown in Tables 3 to 5, together with the kind of each of the copolymers and charge control resins and the like.

TABLE 3

| | | Example 1 | Example 2 | Example 3 | Example 4 | Example 5 | Example 6 |
|---|---|---|---|---|---|---|---|
| Retention aid | Kind | Copolymer 1 | Copolymer 2 | Copolymer 4 | Copolymer 6 | Copolymer 7 | Copolymer 1 |
| | Added amount | 2 | 2 | 2 | 2 | 2 | 2 |
| | Interfacial tension α(mN/m) | 20.7 | 21.5 | 19.5 | 20.8 | 20.8 | 20.7 |
| | Tg(° C.) | 75.2 | 75.3 | 75.8 | 74.6 | 75.7 | 75.2 |
| Charge control resin | Kind | Charge control resin 1 | Charge control resin 1 | Charge control resin 1 | Charge control resin 1 | Charge control resin 1 | Charge control resin 2 |
| | Added amount (part) | 1.00 | 1.00 | 1.00 | 1.00 | 1.00 | 0.45 |
| | Interfacial tension β(mN/m) | 19.8 | 19.8 | 19.8 | 19.8 | 19.8 | 17.1 |
| | Tg(° C.) | 75.4 | 75.4 | 75.4 | 75.4 | 75.4 | 73.7 |
| Interfacial tension | | 0.9 | 1.7 | −0.3 | 1.0 | 1.0 | 3.6 |
| Volume average particle diameter Dv | | 7.7 | 7.8 | 8.2 | 7.8 | 7.5 | 7.6 |
| Particle size distribution Dv/Dp | | 1.11 | 1.12 | 1.14 | 1.11 | 1.11 | 1.11 |
| Heat-resistant temperature(° C.) | | 59 | 58 | 60 | 59 | 59 | 59 |
| Minimum fixing temperature(° C.) | | 125 | 120 | 130 | 125 | 125 | 125 |
| Durability in the N/N environment (sheet) | | 19000 | 19000 | 20000< | 20000< | 20000< | 19000 |
| Durability in the N/N environment after being left at high temperatures (sheet) | | 19000 | 18000 | 20000< | 20000< | 20000< | 19000 |
| Fogging in the H/H environment | | 0.7 | 0.4 | 1.2 | 0.7 | 0.6 | 0.3 |

| | | | Example 7 | Example 8 | Example 9 | Example 10 | Example 11 |
|---|---|---|---|---|---|---|---|
| | Retention aid | Kind | Copolymer 1 | Copolymer 4 | Copolymer 4 | Copolymer 1 | Copolymer 1 |
| | | Added amount | 2 | 2 | 2 | 2 | 2 |
| | | Interfacial tension α(mN/m) | 20.7 | 19.5 | 19.5 | 20.7 | 20.7 |
| | | Tg(° C.) | 75.2 | 75.8 | 75.8 | 75.2 | 75.2 |
| | Charge control resin | Kind | Charge control resin 3 | Charge control resin 2 | Charge control resin 3 | Charge control resin 4 | Charge control resin 7 |
| | | Added amount (part) | 0.20 | 0.45 | 0.20 | 1.45 | 0.45 |
| | | Interfacial tension β(mN/m) | 14.3 | 17.1 | 14.3 | 21.0 | 17.4 |
| | | Tg(° C.) | 73.3 | 73.7 | 73.3 | 74.2 | 81.7 |

TABLE 3-continued

| | | | | | | |
|---|---|---|---|---|---|---|
| | Interfacial tension | 6.4 | 2.4 | 5.2 | −0.3 | 3.3 |
| | Volume average particle diameter Dv | 7.3 | 8.1 | 7.5 | 8.1 | 7.6 |
| | Particle size distribution Dv/Dp | 1.11 | 1.13 | 1.12 | 1.12 | 1.12 |
| | Heat-resistant temperature(° C.) | 58 | 60 | 59 | 60 | 60 |
| | Minimum fixing temperature(° C.) | 120 | 130 | 125 | 125 | 135 |
| | Durability in the N/N environment (sheet) | 19000 | 20000< | 20000< | 18000 | 20000< |
| | Durability in the N/N environment after being left at high temperatures (sheet) | 19000 | 19000 | 19000 | 18000 | 20000< |
| | Fogging in the H/H environment | 0.4 | 0.6 | 0.8 | 1.1 | 0.7 |

TABLE 4

| | | Comparative example 1 | Comparative example 2 | Comparative example 3 | Comparative example 4 | Comparative example 5 |
|---|---|---|---|---|---|---|
| Retention aid | Kind | Copolymer 3 | Copolymer 5 | Copolymer 4 | Copolymer 2 | Copolymer 4 |
| | Added amount (part) | 2 | 2 | 2 | 2 | 2 |
| | Interfacial tension α(mN/m) | 21.8 | 18.4 | 19.5 | 21.5 | 19.5 |
| | Tg(° C.) | 75.7 | 75.6 | 75.8 | 75.3 | 75.8 |
| Charge control resin | Kind | Charge control resin 1 | Charge control resin 2 | Charge control resin 6 | Charge control resin 5 | Charge control resin 4 |
| | Added amount (part) | 1.00 | 0.45 | 0.12 | 2.40 | 1.45 |
| | Interfacial tension β(mN/m) | 19.8 | 17.1 | 12.6 | 23.0 | 21.0 |
| | Tg(° C.) | 75.4 | 73.7 | 74.2 | 74.8 | 74.2 |
| Interfacial tension | | 2.0 | 1.3 | 6.9 | −1.5 | −1.5 |
| Volume average particle diameter Dv | | 7.7 | 9.1 | 7.8 | 8.2 | 8.2 |
| Particle size distribution Dv/Dp | | 1.12 | 1.32 | 1.12 | 1.13 | 1.14 |
| Heat-resistant temperature(° C.) | | 56 | Un-evaluated | 59 | 59 | 61 |
| Minimum fixing temperature(° C.) | | 120 | | 125 | 130 | 135 |
| Durability in the N/N environment (sheet) | | 15000 | | 16000 | 15000 | 16000 |
| Durability in the N/N environment after being left at high | | 10000 | | 14000 | 14000 | 18000 |
| Fogging in the H/H environment | | 0.4 | | 2.5 | 3.2 | 2.3 |

| | | Comparative example 6 | Comparative example 7 | Comparative example 8 | Comparative example 9 |
|---|---|---|---|---|---|
| Retention aid | Kind | Copolymer 2 | Copolymer 8 | Copolymer 9 | Copolymer 1 |
| | Added amount (part) | 2 | 2 | 2 | 2 |
| | Interfacial tension α(mN/m) | 21.5 | 20.4 | 21.0 | 20.7 |
| | Tg(° C.) | 75.3 | 55.6 | 88.4 | 75.2 |
| Charge control resin | Kind | Charge control resin 3 | Charge control resin 2 | Charge control resin 2 | Charge control resin 2 |
| | Added amount (part) | 0.20 | 0.45 | 0.45 | 0.45 |
| | Interfacial tension β(mN/m) | 14.3 | 17.1 | 17.1 | 16.3 |
| | Tg(° C.) | 73.3 | 73.7 | 73.7 | 53.3 |
| Interfacial tension | | 7.2 | 3.3 | 3.9 | 4.4 |
| Volume average | | 7.8 | 7.6 | 7.6 | 7.7 |

TABLE 4-continued

| | | | | |
|---|---|---|---|---|
| particle diameter Dv | | | | |
| Particle size distribution Dv/Dp | 1.12 | 1.11 | 1.11 | 1.12 |
| Heat-resistant temperature(° C.) | 56 | 53 | 61 | 57 |
| Minimum fixing temperature(° C.) | 115 | 115 | 145 | 120 |
| Durability in the N/N environment (sheet) | 11000 | 10000 | 20000< | 18000 |
| Durability in the N/N environment after being left at high | 10000 | 10000 | 20000< | 12000 |
| Fogging in the H/H environment | 0.6 | 0.5 | 0.6 | 0.5 |

TABLE 5

| | | Example 12 |
|---|---|---|
| Retention aid | Kind | Copolymer 2 |
| | Added amount (part) | 2 |
| | Interfacial tension α(mN/m) | 21.5 |
| | Tg(° C.) | 75.3 |
| Charge control resin | Kind | Charge control resin 1 |
| | Added amount (part) | 1.00 |
| | Interfacial tension β(mN/m) | 19.8 |
| | Tg(° C.) | 75.4 |
| Interfacial tension difference (α − β) | | 1.7 |
| Volume average particle diameter Dv | | 7.4 |
| Particle size distribution Dv/Dp | | 1.12 |
| Heat-resistant temperature(° C.) | | 60 |
| Minimum fixing temperature(° C.) | | 130 |
| Durability in the N/N environment (sheet) | | 20000< |
| Durability in the N/N environment after being left at high temperatures | | 20000< |
| Fogging in the H/H environment | | 0.8 |

7. Evaluation of Toner

Hereinafter, the evaluation results of the toners will be reviewed with reference to Tables 3 to 5.

Table 4 shows that the inter facial tension α according to the copolymer 3 used for the toner of Comparative example 1 is 21.8 mN/m and the glass transition temperature is 75.7° C. Further, the interfacial tension β according to the charge control resin 1 used for the toner of Comparative example 1 is 19.8 mN/m and the glass transition temperature is 75.4° C.

Table 4 shows that the toner of Comparative example 1 has a minimum fixing temperature of 120° C. and a fog value in the H/H environment of 0.4. Thus, there is no problem with at least low-temperature fixability and fog.

However, in the toner of Comparative example 1, the heat-resistant temperature is as low as 56° C., the number of sheets for evaluation of durability in the N/N environment is as low as 15,000 sheets, and the number of sheets for evaluation of durability in the N/N environment after being left at high temperatures is as low as 10,000 sheets. It is considered that the above is due to the fact that the interfacial tension α is too high, and thus the amount of the retention aid on the toner particle surface decreases, and as a result, the heat-resistant shelf stability is poor and the print quality after being left at high temperatures decreases significantly.

Table 4 shows that the interfacial tension α according to the copolymer 5 used for the toner of Comparative example 2 is 18.4 mN/m and the glass transition temperature is 75.6° C. Further, the interfacial tension β according to the charge control resin 2 used for the toner of Comparative example 2 is 17.1 mN/m and the glass transition temperature is 73.7° C.

Table 4 shows that the volume average particle diameter Dv of the toner of Comparative example 2 is 9.1 μm. This results in a difference (1 μm or more) with a target value of 8.0 μm. Further, the particle size distribution Dv/Dp of the toner of Comparative example 2 is as high as 1.32. It is considered that the above is due to the fact that the interfacial tension α is too low, namely the hydrophilicity of the copolymer 5 is too high with respect to the polarity of a polymerizable monomer composition of 75 parts of styrene and 25 parts of n-butyl acrylate, thus the droplets produced during suspension polymerization become unstable and the toner particle diameter becomes larger, and as a result, it becomes difficult to obtain a toner having a target particle diameter.

Table 4 shows that the interfacial tension α according to the copolymer 4 used for the toner of Comparative example 3 is 19.5 mN/m and the glass transition temperature is 75.8° C. Further, the interfacial tension β according to the charge control resin 6 used for the toner of Comparative example 3 is 12.6 mN/m and the glass transition temperature is 74.2° C.

Table 4 shows that the toner of Comparative example 3 has a heat-resistant temperature of 59° C. and a minimum fixing temperature of 125° C. Thus, there is no problem with at least heat-resistant shelf stability and low-temperature fixability.

However, in the toner of Comparative example 3, the number of sheets for evaluation of durability in the N/N environment is as low as 16,000 sheets, the number of sheets for evaluation of durability in the N/N environment after being left at high temperatures is as low as 14,000 sheets, and the fog value in the H/H environment is as high as 2.5. It is considered that the above is due to the fact that the interfacial tension β is too low and thus the hygroscopicity increases, and as a result, the print quality of the toner in the high temperature and high humidity (H/H) environment deteriorates.

Table 4 shows that the interfacial tension α according to the copolymer 2 used for the toner of Comparative example 4 is 21.5 mN/m and the glass transition temperature is 75.3° C. Further, the interfacial tension β according to the charge control resin 5 used for the toner of Comparative example 4 is 23.0 mN/m and the glass transition temperature is 74.8° C.

Table 4 shows that the toner of Comparative example 4 has a heat-resistant temperature of 59° C. and a minimum fixing temperature of 130° C. Thus, there is no problem with at least heat-resistant shelf stability and low-temperature fixability.

However, in the toner of Comparative example 4, the number of sheets for evaluation of durability in the N/N environment is as low as 15,000 sheets, the number of sheets for evaluation of durability in the N/N environment after being left at high temperatures is as low as 14,000 sheets, and the fog value in the H/H environment is as high as 3.2. This is because, similarly to Comparative example 3, the interfacial tension β is too low. Further, it is considered that the above is due to the fact that the interfacial tension difference (α−β) is also too low and thus the charge control resin is easily present inside the toner, compared to the retention aid, and the charge controlling function cannot be sufficiently exerted, and as a result, the print quality of the toner in the (H/H) environment deteriorates.

The physical properties of the copolymer 4 used for the toner of Comparative example 5 are as described above. Table 4 shows that the interfacial tension β according to the charge control resin 4 used for the toner of Comparative example 5 is 21.0 mN/m and the glass transition temperature is 74.2° C.

Table 4 shows that the toner of Comparative example 5 has a heat-resistant temperature of 61° C. Thus, there is no problem with at least heat-resistant shelf stability.

However, in the toner of Comparative example 5, the minimum fixing temperature is as low as 135° C., the number of sheets for evaluation of durability in the N/N environment is as low as 16,000 sheets, the number of sheets for evaluation of durability in the N/N environment after being left at high temperatures is as low as 15,000 sheets, and the fog value in the H/H environment is as high as 2.3. This is because, similarly to Comparative example 4, the interfacial tension difference (α−β) is too low.

The physical properties of the copolymer 2 used for the toner of Comparative example 6 are as described above. Table 4 shows that the interfacial tension β according to the charge control resin 3 used for the toner of Comparative example 6 is 14.3 mN/m and the glass transition temperature is 73.3° C.

Table 4 shows that the toner of Comparative example 6 has a minimum fixing temperature of 115° C. and a fog value in the H/H environment of 0.6. Thus, there is no problem with at least low-temperature fixability and fog.

However, in the toner of Comparative example 6, the heat-resistant temperature of the toner is as low as 56° C., the number of sheets for evaluation of durability in the N/N environment is as low as 11,000 sheets, and the number of sheets for evaluation of durability in the N/N environment after being left at high temperatures is as low as 10,000 sheets. It is considered that the above is due to the fact that the interfacial tension difference (α−β) is too high and thus the affinity of the retention aid for the charge control resin decreases, and as a result, the retention aid is not easily present on the surface of the toner, and the continuous printing durability, heat-resistant shelf stability and print quality after being left at high temperatures deteriorate.

Table 4 shows that the interfacial tension α according to the copolymer 8 used for the toner of Comparative example 7 is 20.4 mN/m and the glass transition temperature is 55.6° C. The physical properties of the charge control resin 2 used for the toner of Comparative example 7 are as described above.

Table 4 shows that, in the toner of Comparative example 7, the minimum fixing temperature is 115° C., the number of sheets for evaluation of durability in the N/N environment is 18,000 sheets, and the fog value in the H/H environment is 0.5. Thus, there is no problem with at least low-temperature fixability, printing durability in the normal temperature and normal humidity (N/N) environment, and fog.

However, in the toner of Comparative example 7, the heat-resistant temperature is as low as 53° C. and the number of sheets for evaluation of durability in the N/N environment after being left at high temperatures is as low as 10,000 sheets. It is considered that the above is due to the fact that the glass transition temperature of the copolymer 8 is too low and thus the heat-resistant shelf stability is particularly poor.

Table 4 shows that the interfacial tension α according to the copolymer 9 used for the toner of Comparative example 8 is 21.0 mN/m and the glass transition temperature is 88.4° C. The physical properties of the charge control resin 2 used for the toner of Comparative example 8 are as described above.

Table 4 shows that, in the toner of Comparative example 8, the heat-resistant temperature is 61° C., both the number of sheets for evaluation of durability in the N/N environment and the number of sheets for evaluation of durability in the N/N environment after being left at high temperatures exceed 20,000 sheets, and the fog value in the H/H environment is 0.6. Thus, there is no problem with at least heat-resistant shelf stability, printing durability, and fog.

However, in the toner of Comparative example 8, the minimum fixing temperature is as high as 145° C. It is considered that the above is caused due to the fact that the glass transition temperature of the copolymer 9 is too high and thus the low-temperature fixability is poor.

Table 4 shows that the interfacial tension α according to the copolymer 1 used for the toner of Comparative example 9 is 20.7 mN/m and the glass transition temperature is 75.2° C. Table 4 shows that the interfacial tension β according to the charge control resin 8 used for the toner of Comparative example 9 is 16.3 mN/m and the glass transition temperature is 53.3° C.

Table 4 shows that, in the toner of Comparative example 9, the heat-resistant temperature is 57° C., the minimum fixing temperature is 120° C., the number of sheets for evaluation of durability in the N/N environment is 18,000 sheets, and the fog value in the H/H environment is 0.5. Thus, there is no problem with at least heat-resistant shelf stability, low-temperature fixability, printing durability in the normal temperature and normal humidity (N/N) environment, and fog.

However, in the toner of Comparative example 9, the number of sheets for evaluation of durability in the N/N environment after being left at high temperatures is as low as 12,000 sheets. It is considered that the above is due to the fact that the glass transition temperature of the charge control resin 8 is too low, and thus the print quality of the toner after being left at high temperatures deteriorates.

On the other hand, Tables 3 and 5 show that the interfacial tension α according to each of the copolymers used for the toners of Examples 1 to 12 is 19.5 to 21.5 mN/m and the glass transition temperature is from 74.6 to 75.8° C., meanwhile, the interfacial tension β according to each of the charge control resins used for the toners is 14.3 to 21.0 mN/m and the glass transition temperature is 73.3 to 81.7° C.

Tables 3 and 5 show that, in the toners of Examples 1 to 12, the heat-resistant temperature is as high as 58° C. or more, the minimum fixing temperature is as low as 135° C. or less, both the number of sheets for evaluation of durability in the N/N environment and the number of sheets for evaluation of durability in the N/N environment after being left at high temperatures are as high as 18,000 sheets or more, and the fog value in the H/H environment is as low as 1.2 or less.

Therefore, it is found that the toner of the present invention which contains 1 to 4 parts by mass of retention aid and 0.1 to 20 parts by mass of charge control resin with respect to 100 parts by mass of a binder resin containing 67 to 78% by mass of styrene-based monomer unit and 22 to 33% by mass of (meth)acrylic acid alkyl monomer unit and in which the retention aid and the charge control resin satisfy the formulae (1) to (3), the glass transition temperature of the retention aid is 60 to 80° C. and the glass transition temperature of the charge control resin is 55 to 90° C. has an excellent balance between heat-resistant shelf stability and low-temperature fixability, is excellent in durability during regular use and after being left at high temperatures, and causes less occurrence of fogging in high temperature and high humidity environments.

The invention claimed is:

1. A toner comprising a binder resin, a colorant, a release agent, a first copolymer, and a charge control resin, wherein the binder resin is a second copolymer containing 67 to 78% by mass of a styrene-based monomer unit and 22 to 33% by mass of a (meth)acrylic acid alkyl monomer unit;

wherein the styrene-based monomer unit is a monomer unit relating to at least one kind of monomer selected from the group consisting of styrene, vinyltoluene, methylstyrene and ethylstyrene;

wherein the (meth)acrylic acid alkyl monomer unit is a monomer unit relating to at least one kind of monomer selected from the group consisting of methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, and dimethylaminoethyl methacrylate;

wherein the first copolymer is at least one of acrylic acid and methacrylic acid, and at least one of acrylic acid ester and methacrylic acid ester;

wherein the mass ratio of acrylic acid ester monomer unit, methacrylic acid ester monomer unit, acrylic acid monomer unit and methacrylic acid monomer unit is a ratio of (at least one of acrylic acid ester monomer unit and methacrylic acid ester monomer unit): (at least one of acrylic acid monomer unit and methacrylic acid monomer unit) =(99 to 99.95): (0.05 to 1);

wherein a content of the first copolymer is 1 to 4 parts by mass with respect to 100 parts by mass of the binder resin;

wherein the charge control resin is a negative charge control resin;

wherein a content of the negative charge control resin is 0.1 to 20 parts by mass with respect to 100 parts by mass of the binder resin; and wherein, when an interfacial tension of a solution of 1 part by mass of the first copolymer dissolved in a mixture of 72 parts by mass of styrene and 28 parts by mass of n-butyl acrylate is $\alpha$ (mN/m) with respect to water, and an interfacial tension of a solution of 1 part by mass of the negative charge control resin dissolved in a mixture of 72 parts by mass of styrene and 28 parts by mass of n-butyl acrylate is $\beta$ (mN/m) with respect to water, the following formulae (1) to (3) are all satisfied and a glass transition temperature of the first copolymer and that of the negative charge control resin are 60 to 80° C. and 55 to 90° C., respectively:

$$19.0 \leq \alpha \leq 21.6 \quad \text{Formula (1)}$$

$$13.0 \leq \beta \leq 22.0 \quad \text{Formula (2)}$$

$$-1.0 \leq \alpha - \beta \leq 7.0 \quad \text{Formula (3).}$$

* * * * *